US007047787B2

(12) United States Patent
Kanemitsu et al.

(10) Patent No.: US 7,047,787 B2
(45) Date of Patent: May 23, 2006

(54) METHOD OF FORMING SPLINE AND KEYWAY FOR SHEET METAL ROTATING MEMBER WITH BOSS PART

(75) Inventors: Toshiaki Kanemitsu, Kobe (JP); Naoki Fujii, Kobe (JP); Kazuo Iwata, Kobe (JP)

(73) Assignee: Kanemitsu Corporation, Akashi (JP)

( * ) Notice: Subject to any disclaimer, the term of this patent is extended or adjusted under 35 U.S.C. 154(b) by 96 days.

(21) Appl. No.: 10/503,084

(22) PCT Filed: Apr. 25, 2002

(86) PCT No.: PCT/JP02/04113

§ 371 (c)(1),
(2), (4) Date: Jul. 30, 2004

(87) PCT Pub. No.: WO03/064073

PCT Pub. Date: Aug. 7, 2003

(65) Prior Publication Data

US 2005/0061050 A1 Mar. 24, 2005

(30) Foreign Application Priority Data

Jan. 31, 2002 (JP) ..... 2002-023455

(51) Int. Cl.
*B21J 13/00* (2006.01)

(52) U.S. Cl. ..... 72/355.4; 72/355.2; 72/352; 72/343; 72/354.6

(58) Field of Classification Search ..... 72/355.2, 72/343, 352, 354.2, 354.6, 375; 29/893.34
See application file for complete search history.

(56) References Cited

U.S. PATENT DOCUMENTS

| | | | | |
|---|---|---|---|---|
| 3,688,549 | A * | 9/1972 | Ohnishi et al. | 72/334 |
| 4,245,491 | A * | 1/1981 | Kondo et al. | 72/254 |
| 6,688,153 | B1 * | 2/2004 | Kanamaru et al. | 72/356 |

FOREIGN PATENT DOCUMENTS

| | | | |
|---|---|---|---|
| JP | 64-6557 | A | 1/1989 |
| JP | 3-19841 | A | 8/1991 |
| JP | 06297071 | A * | 10/1994 |
| JP | 10-296377 | A | 1/1998 |
| JP | 11-57914 | A | 3/1999 |
| JP | 2000-225421 | A | 8/2000 |
| JP | 2001-286961 | | 10/2001 |

* cited by examiner

*Primary Examiner*—Dmitry Suhol
(74) *Attorney, Agent, or Firm*—Bacon & Thomas

(57) ABSTRACT

An annular excess portion is disposed, a spline forming male mold is passed through a boss of a sheet metal-made rotary member in which a root portion of the boss and a peripheral portion are previously displaced, and the boss is set to a stationary mold with being fitted into a boss fitting hole of a rotary member holding mold. Thereafter, the annular excess portion is clamped between a pressing mold and the stationary mold to be deformed into a flat shape, and the root portion of the boss is squeezed into spline forming grooves to be plastically deformed, thereby forming a boss spline. According to the configuration, increase in thickness os a sheet metal blank is avoided, the strength of the boss is ensured, and weight reduction is achieved. The production efficiency can be remarkably improved, and cutting chips are eliminated, so that adverse influence on the working environment can be avoided.

12 Claims, 16 Drawing Sheets

METHOD OF FORMING SPLINE AND KEYWAY FOR SHEET METAL ROTATING MEMBER WITH BOSS PART

TECHNICAL FIELD

The present invention relates to a method of forming a spline in a boss of a sheet metal-made rotary member having a boss, such as a pulley, and also to a method of forming a keyway in a boss of such a sheet metal-made rotary member.

BACKGROUND ART

As shown in FIG. 17, as means for coupling a rotary shaft 4 to a sheet metal-made rotary member 1 having a boss 2 and a peripheral portion 3 on the outer periphery thereof, such as a pulley, often used are spline coupling means for fitting a shaft spline disposed on the rotary shaft 4 to a boss spline 5 disposed in the boss 2 of the sheet metal-made rotary member 1, and key coupling means belonging to sunk keys such as a knock key or a stud key which is not shown.

When the boss spline 5 or a boss key way is to be formed in the boss 2 of the sheet metal-made rotary member 1 in which such coupling means is used, conventionally, a forming method based on a cutting process is usually employed. In the case where the boss spline 5 is to be formed by a cutting process, however, the effective thickness t1 of the boss 2 is made thinner than the thickness T of a sheet metal blank in accordance with the depth D of the boss spline 5 as shown in FIG. 18, whereby the strength of the boss 2 is correspondingly reduced. Therefore, the thickness T of the sheet metal blank must be thickened more than necessary in order to ensure the strength of the boss 2. This causes the weight of the sheet metal-made rotary member 1 to be increased, thereby blocking the reduction of the weight. As a result, the cost is raised in correspondence with the increase of the weight. The cutting process speed inevitably has a technical limitation, and hence the boss spline 5 cannot be formed in a short time. Therefore, the cost reduction due to improvement of the production efficiency cannot be expected. Moreover, there are drawbacks such as that cutting chips produced in the cutting process adversely affect the working environment. Such drawbacks are similarly caused also in the case where the boss key way is formed by the cutting process.

DISCLOSURE OF THE INVENTION

The invention has been conducted in view of the above-mentioned circumstances. It is an object of the invention to provide a method of forming a spline of a sheet metal-made rotary member having a boss, and a method of forming a keyway in which weight reduction can be achieved by ensuring the strength of the boss without causing the thickness of a sheet metal blank to be increased more than necessary, the time for forming a boss spline or a boss keyway can be shortened to improve the production efficiency of a sheet metal-made rotary member, and production of cutting chips can be eliminated to avoid adverse influence on the working environment.

The method of forming a spline of a sheet metal-made rotary member having a boss according to the invention set forth in claim 1 is a method of forming a spline in a boss of a sheet metal-made rotary member which comprises a boss and a peripheral portion in an outer periphery of the boss, and in which an annular excess portion that protrudes in one axial direction of the boss is disposed between the boss and the peripheral portion, and a root portion of the boss and the peripheral portion are displaced in the axial direction of boss, wherein a spline forming male mold is passed through the boss of the sheet metal-made rotary member, the boss is fitted into a boss fitting hole of a rotary member holding mold to hold the sheet metal-made rotary member to the rotary member holding mold in a state where the annular excess portion separates from a holding face, a pressing mold is then impelled toward the rotary member holding mold to press the annular excess portion against the holding face of the rotary member holding mold, and the root portion of the boss is squeezed against the spline forming male mold to be plastically deformed, while the annular excess portion is clamped between a pressing face of the pressing mold and the holding face of the rotary member holding mold to be deformed into a flat shape, whereby a boss spline is formed in the root portion of the boss.

The method of forming a keyway of a sheet metal-made rotary member having a boss according to the invention set forth in claim 7 is a method of forming a keyway in a boss of a sheet metal-made rotary member which comprises a boss and a peripheral portion in the outer periphery of the boss, and in which an annular excess portion that protrudes in one axial direction of the boss is disposed between the boss and the peripheral portion, and a root portion of the boss and the peripheral portion are displaced in the axial direction of the boss, wherein a keyway forming male mold is passed through the boss of the sheet metal-made rotary member, the boss is fitted into a boss fitting hole of a rotary member holding mold to hold the sheet metal-made rotary member to the rotary member holding mold in a state where the annular excess portion separates from a holding face, a pressing mold is then impelled toward the rotary member holding mold to press the annular excess portion against the holding face of the rotary member holding mold, and the root portion of the boss is squeezed against the keyway forming male mold to be plastically deformed, while the annular excess portion is clamped between a pressing face of the pressing mold and the holding face of the rotary member holding mold to be deformed into a flat shape, whereby a boss keyway is formed in the root portion of the boss.

According to the invention set forth in claim 1 having the above-mentioned essential components, the thickness of the sheet metal blank can be made equal to the effective thickness of the boss, and hence the necessary strength of the boss can be ensured. Therefore, the thickness of the sheet metal blank can be prevented from being thickened more than necessary in order to ensure the strength of the boss, increase in weight can be suppressed, reduction of the weight of the sheet metal-made rotary member can be achieved, and the cost can be correspondingly reduced. Furthermore, the boss spline is formed by squeezing the root portion of the boss against the spline forming male mold to be plastically deformed in a moment. Therefore, the production efficiency can be remarkably improved, and significant cost reduction can be expected from both the viewpoints of material and production. Moreover, cutting chips are not produced in the formation of the boss spline, and hence it is possible to attain the effect that adverse influence on the working environment can be avoided.

According to the invention set forth in claim 7 having the essential components described above, in the same manner as the invention set forth in claim 1, the thickness of the sheet metal blank can be made equal to the effective thickness of the boss, and hence the necessary strength of the boss can be ensured. Therefore, the thickness of the sheet metal blank can be prevented from being thickened more than necessary in order to ensure the strength of the boss, increase in weight can be suppressed, reduction of the weight of the sheet metal-made rotary member can be achieved, and the cost can be correspondingly reduced. Furthermore, the boss keyway is formed by squeezing the root portion of the boss against the keyway forming male mold to be plastically deformed in a moment. Therefore, the production efficiency can be remarkably improved, and significant cost reduction can be expected from both the viewpoints of material and production. Moreover, cutting chips are not produced in the formation of the boss keyway, and hence it is possible to attain the effect that adverse influence on the working environment can be avoided.

In the method of forming a spline of a sheet metal-made rotary member having a boss, as in the mode of the invention set forth in claim 2, when the boss spline is formed by squeezing the root portion of the boss against the spline forming male mold to be plastically deformed, while the annular excess portion is clamped between the pressing face of the pressing mold and the holding face of the rotary member holding mold to be deformed into a flat shape, preferably, a tip end of the boss is caused to butt against an end face of a truncated conical restricting member which is incorporated into the rotary member holding mold, thereby restricting elongation of the tip end of the boss in the axial direction of the boss.

According to the mode of the invention set forth in claim 2, when the root portion of the boss is squeezed against the spline forming male mold to be plastically deformed, the tip end of the boss butts against the end face of the restricting member to restrict elongation of the tip end of the boss in the axial direction. Therefore, the boss spline can be accurately formed, and the length in the axial direction of the boss can be uniformly set, so that dispersions of the quality and accuracy of the product (sheet metal-made rotary member having a spline) can be suppressed.

In the method of forming a keyway of a sheet metal-made rotary member having a boss, as in the mode of the invention set forth in claim 8, when the boss keyway is formed by squeezing the root portion of the boss against the keyway forming male mold to be plastically deformed, while the annular excess portion is clamped between the pressing face of the pressing mold and the holding face of the rotary member holding mold to be deformed into a flat shape, preferably, a tip end of the boss is caused to butt against an end face of a truncated conical restricting member which is incorporated into the rotary member holding mold, thereby restricting elongation of the tip end of the boss in the axial direction.

According to the mode of the invention set forth in claim 8, as in the mode of the invention set forth in claim 2, when the root portion of the boss is squeezed against the keyway forming male mold to be plastically deformed, the tip end of the boss butts against the end face of the restricting member to restrict elongation of the tip end of the boss in the axial direction. Therefore, the boss keyway can be accurately formed, and the length in the axial direction of the boss can be uniformly set, so that dispersions of the quality and accuracy of the product (sheet metal-made rotary member having a spline) can be suppressed.

BEST MODE FOR CARRYING OUT THE INVENTION

Figure 17:
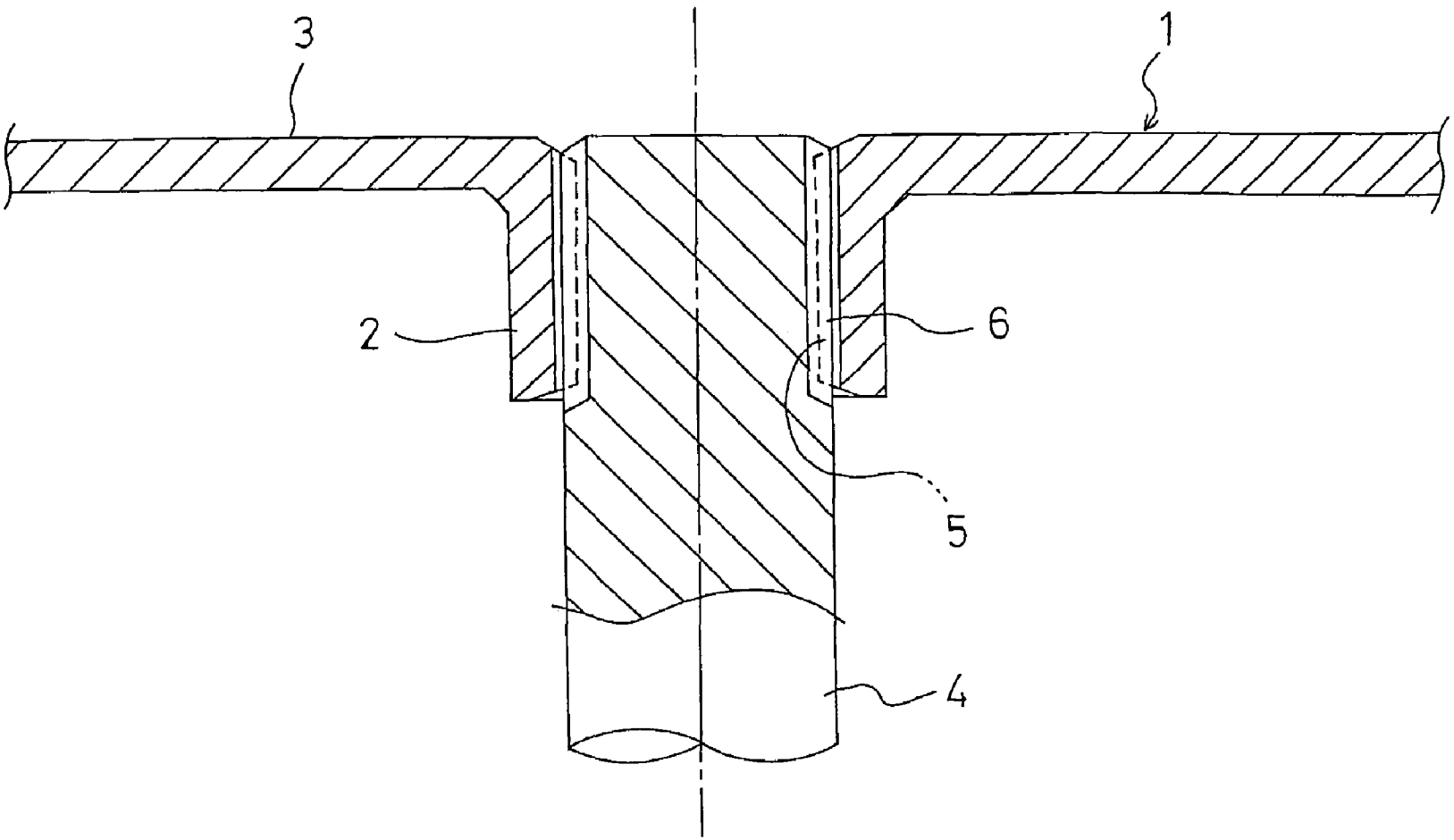
FIG. 17 is a section view showing an example of spline coupling between a sheet metal-made rotary member and a rotary shaft.
Figure 18:
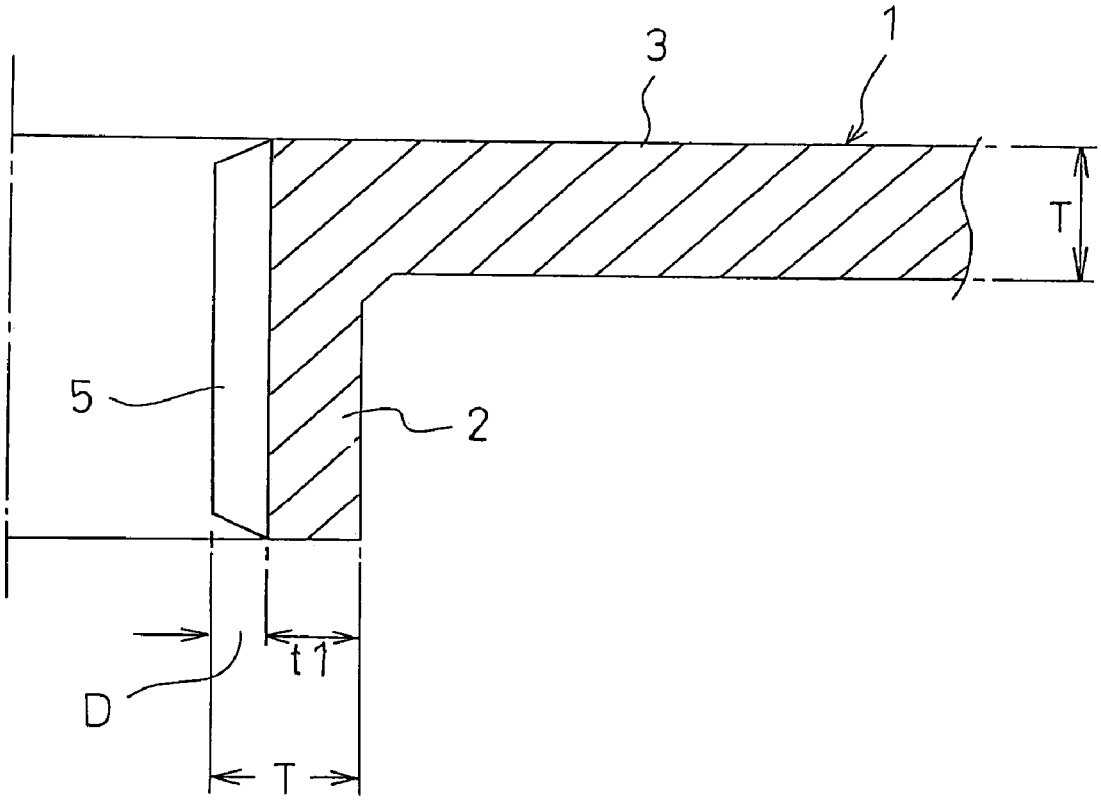
FIG. 18 is an enlarged section view showing a conventional boss spline.

Hereinafter, a preferred embodiment of the method of forming a spline of a sheet metal-made rotary member having a boss according to the invention set forth in claim 1 will be described with reference to the drawings. In the embodiment, components identical with those of the conventional art example which has been described with reference to FIGS. 17 and 18 are denoted by the same reference numerals.

Figure 1:
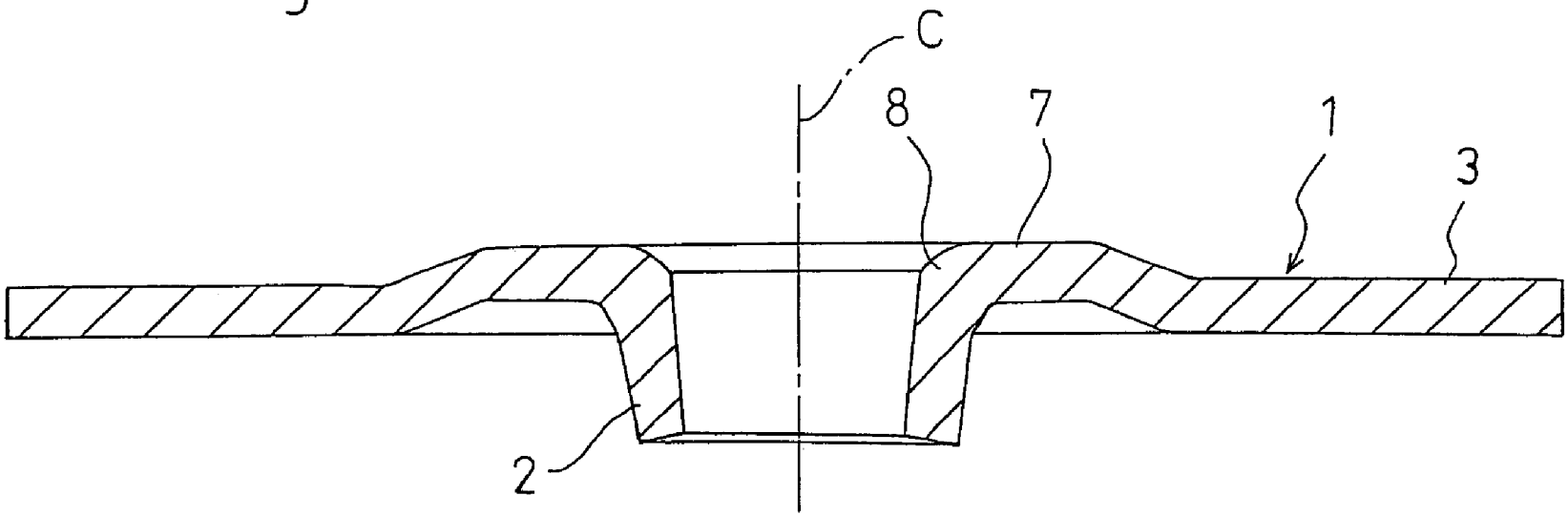
FIG. 1 is a longitudinal section view showing an example of a sheet metal-made rotary member which is applied to the modes of the invention set forth in claims 1 and 7.

In the sheet metal-made rotary member 1 serving as an object in which a spline is to be formed, as shown in FIG. 1, an annular excess portion 7 is disposed between the boss 2 and the peripheral portion 3 so as to protrude in one of the direction of the axis C of the boss 2, so that the position of a root portion 8 of the boss 2, and that of the peripheral portion 3 are previously displaced toward in the one direction of the axis C.

Figure 2:
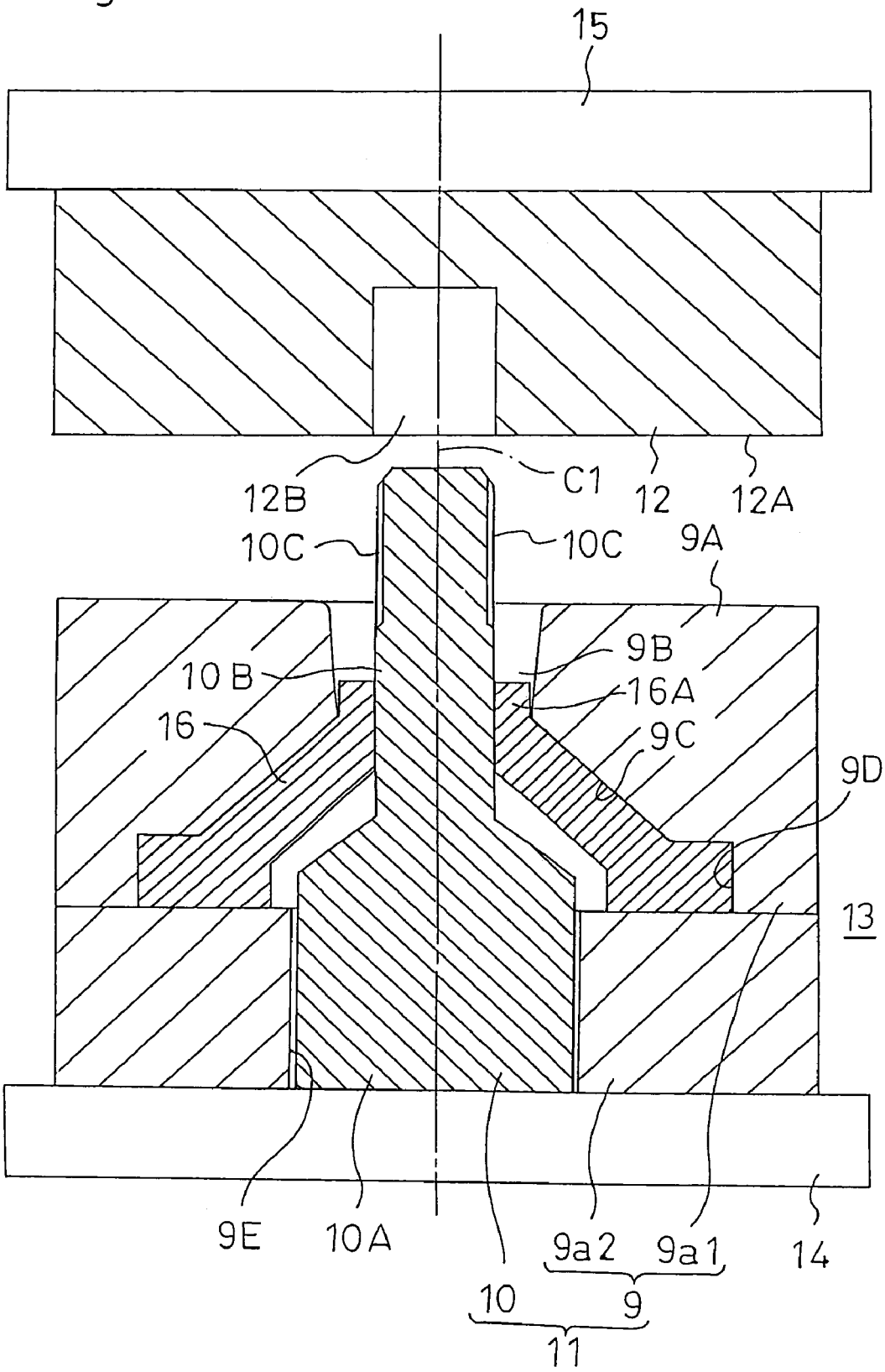
FIG. 2 is a longitudinal section view showing an example of a press molding apparatus which is applied to an embodiment of the invention set forth in claim 1.

By contrast, as shown in FIG. 2, a press molding apparatus 13 which is used for forming a spline comprises: a stationary mold 11 composed of a rotary member holding mold 9 into which a restricting member 16 is incorporated, and a spline forming male mold 10; and a pressing mold 12 which has an axis C1 identical with that of the stationary mold 11, and which approaches and separates from the stationary mold to function as a movable mold.

The rotary member holding mold 9 is configured by a split mold in which an upper mold 9*a*1 and a lower mold 9*a*2 that are separated from each other in the direction of the axis C1. A flat holding face 9A which is perpendicular to the axis C1 is disposed on the upper face of the upper mold 9*a*1 which is opposed to the pressing mold 12. A boss fitting hole 9B which is centered at the axis C1, a first restricting member holding hole 9C which has a truncated conical shape, and a second restricting member holding hole 9D which has a larger diameter are concentrically disposed so as to communicate with one another as downward advancing from the holding face 9A. Furthermore, a spline forming male mold holding hole 9E which is centered at the axis C1 is disposed in the lower mold 9*a*2 so as to communicate with the large-diameter second restricting member holding hole 9D of the upper mold 9*a*1. The spline forming male mold 10 has a large-diameter basal portion 10A, and a small-diameter shaft portion 10B. A plurality of spline forming grooves 10C, 10C, . . . which elongate in the axial direction are disposed at intervals along the circumferential direction in the outer periphery of a tip end portion of the small-diameter shaft portion 10B and its vicinity.

The restricting member 16 has a substantially inverted funnel-like shape, and is held with being fitted from the lower side into the first restricting member holding hole 9C and the second hole 9D of the upper mold 9*a*1 in a state where the member is passed through the spline forming male mold 10 and placed on the upper face of the lower mold 9*a*2 of the rotary member holding mold 9. A small-diameter restricting portion 16A in an upper end portion of the member faces the boss fitting hole 9B.

The stationary mold 11 is configured by a combination of the rotary member holding mold 9 into which the restricting member 16 is incorporated, and the spline forming male mold 0.10. Specifically, the large-diameter basal portion 10A of the spline forming male mold 10 is fitted into the spline forming male mold holding hole 9E of the lower mold 9*a*2, and the tip end portion of the small-diameter shaft portion 10B is projected from the holding face 9A of the upper mold 9*a*1 toward the pressing mold 12, so that axial parts of the spline forming grooves 10C, 10C, . . . face the boss fitting hole 9B. In this state, the molds are combined with each other while the center axis of the spline forming male mold 10 is made coincident with the axis C1 of the rotary member holding mold 9. The stationary mold 11 is held undisplaceably and detachably to the face of a stationary mold holding table 14 by holding means (not shown) such as a clamp.

In the pressing mold 12 functioning as a movable mold, a flat pressing face 12A which is perpendicular to the axis C1 is disposed so as to be opposed to the flat holding face 9A of the upper mold 9*a*1 of the rotary member holding mold 9, and a shaft fitting recess 12 which is centered at the axis C1 is disposed so as to be opposed to the small-diameter shaft portion 10B of the spline forming male mold 10. The pressing mold is held undisplaceably and detachably to the face of a movable mold holding table 15 by holding means (not shown) such as a clamp. The movable mold holding table 15 is caused to advance and retract by an advancing/retracting mechanism which is not shown, so that the pressing face 12A of the pressing mold 12 approaches and separates from the holding face 9A of the rotary member holding mold 9 in the stationary mold 11.

Next, a method of forming a boss spline in the boss 2 of the sheet metal-made rotary member 1 shown in FIG. 1 with using the thus configured press molding apparatus 13 will be described.

Figure 3:
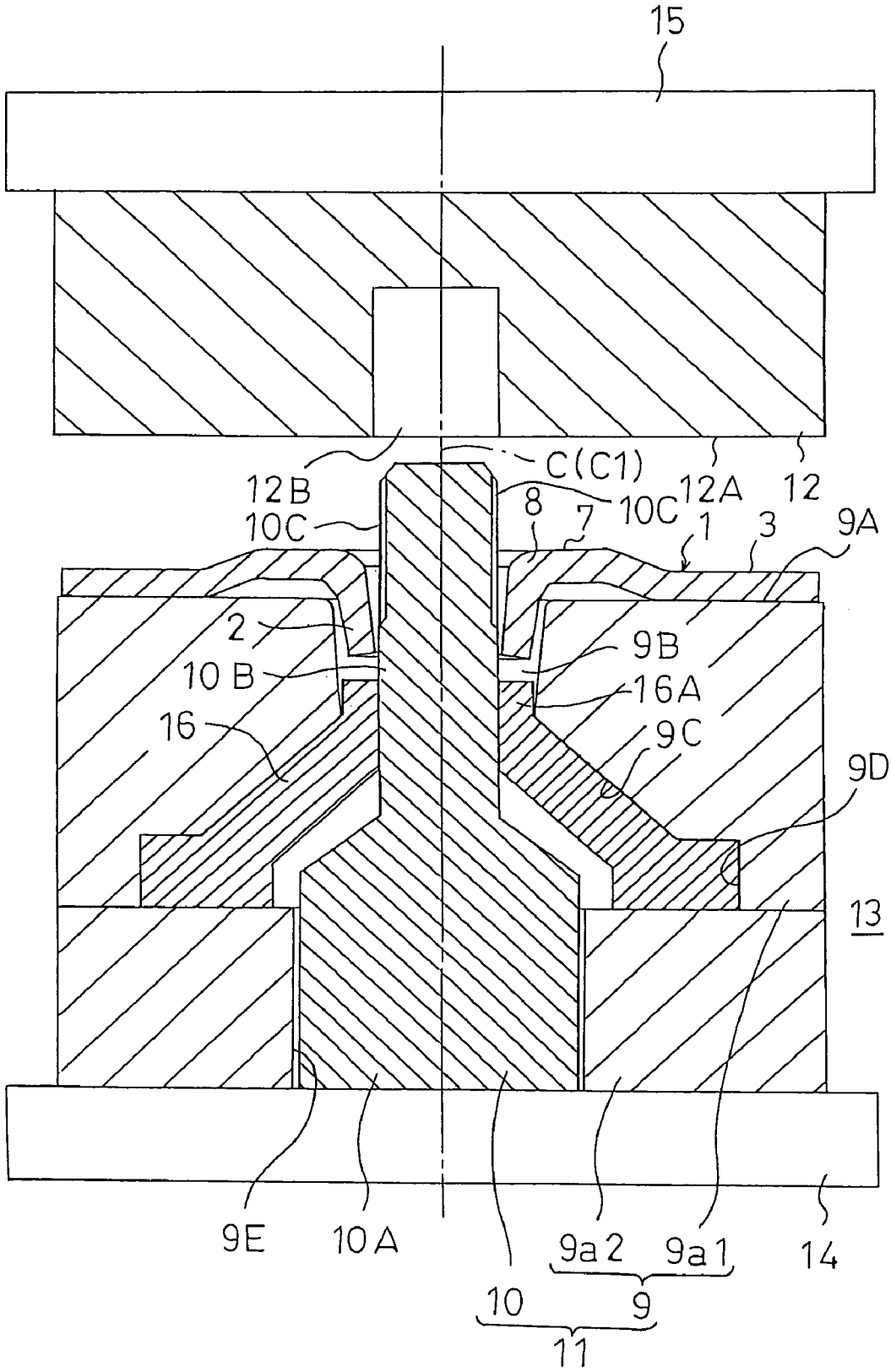
FIG. 3 is a longitudinal section view of a state where the sheet metal-made rotary member is set to a stationary mold.

As shown in FIG. 3, first, the sheet metal-made rotary member 1 is set to the stationary mold 11 in the state where the small-diameter shaft portion 10B of the spline forming male mold 10 is passed through the boss 2 of the sheet metal-made rotary member 1, and the boss 2 is fitted into the boss fitting hole 9B of the rotary member holding mold 9, so that the lower end (tip end) of the boss 2 is opposed to the upper end (tip end) of the small-diameter restricting portion 16A of the restricting member 16, and the peripheral portion 3 of the sheet metal-made rotary member 1 is placed (butts) on the holding face 9A of the rotary member holding mold 9. In the set state, the annular excess portion 7 is separated from the holding face 9A.

Figure 4:
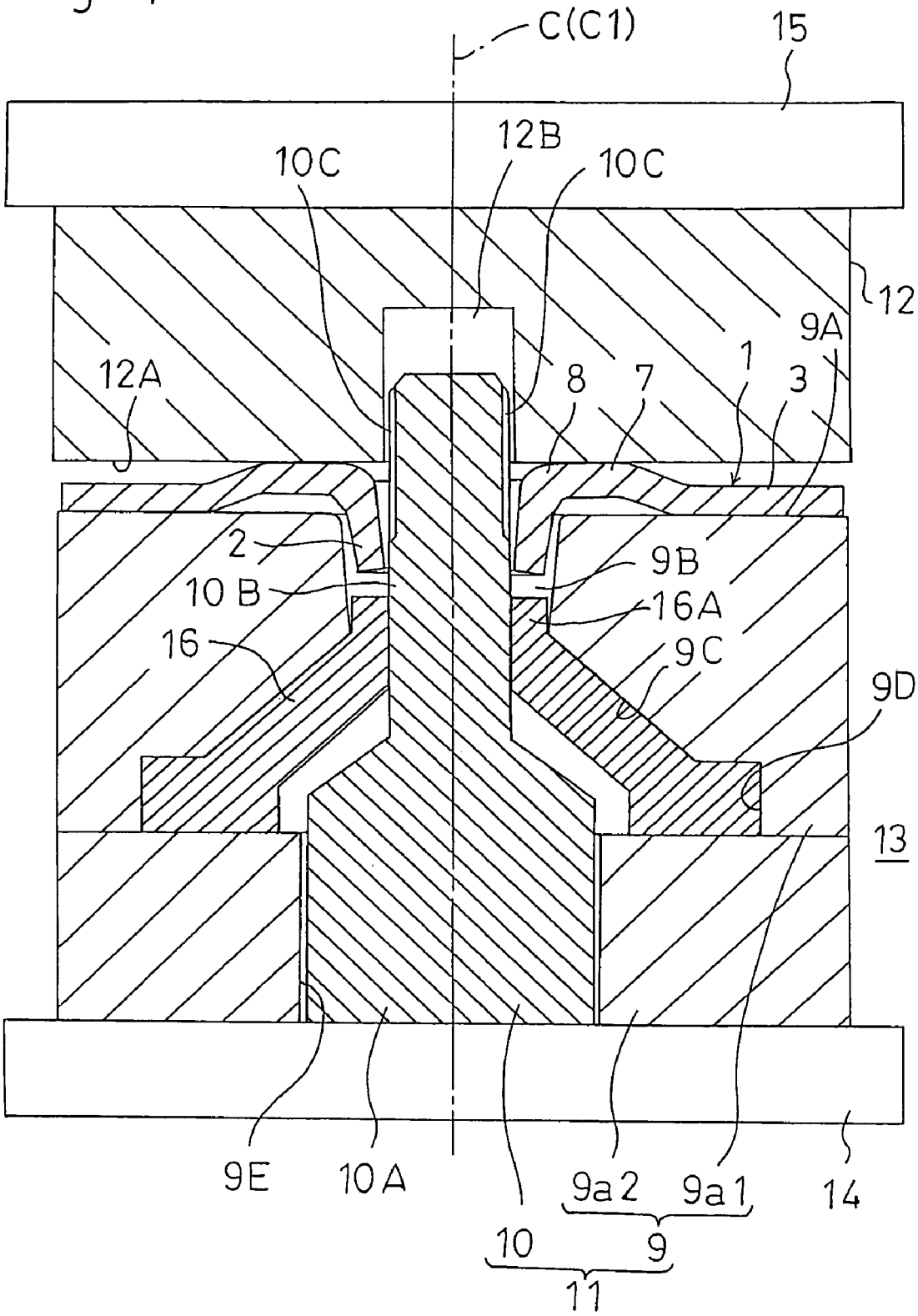
FIG. 4 is a longitudinal section view of a state where a pressing face of a pressing mold butts against an annular excess portion.

Next, the movable mold holding table 14 and the pressing mold 12 are impelled toward the stationary mold 11. First, the tip end side of the small-diameter shaft portion 10B of the spline forming male mold 10 is fitted into the shaft fitting recess 12B. As shown in FIG. 4, then, the pressing face 12A of the pressing mold 12 butts against the annular excess portion 7 of the sheet metal-made rotary member 1.

Figure 5:
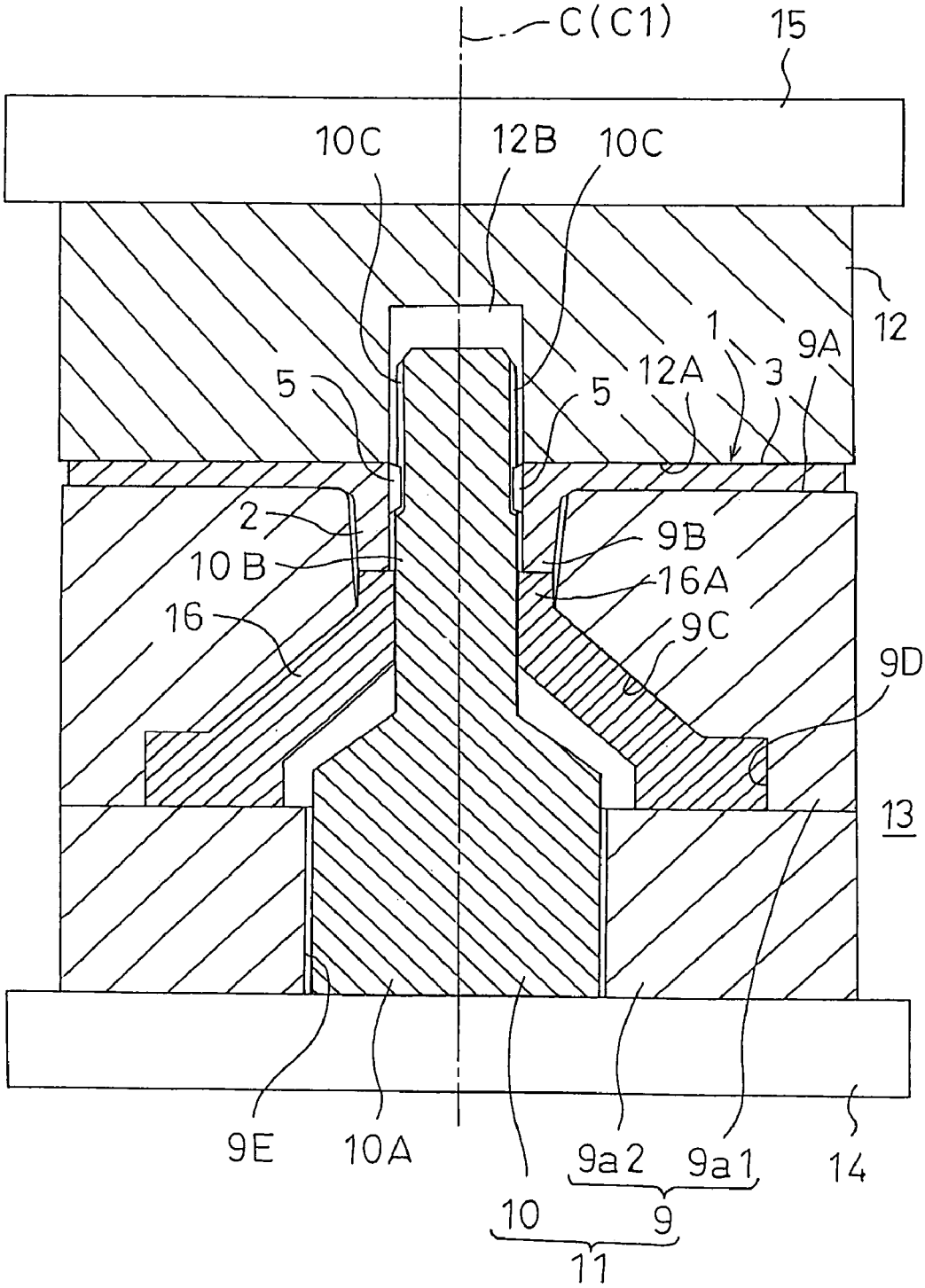
FIG. 5 is a longitudinal section view of a state where the annular excess portion is deformed into a flat shape.
Figure 6:
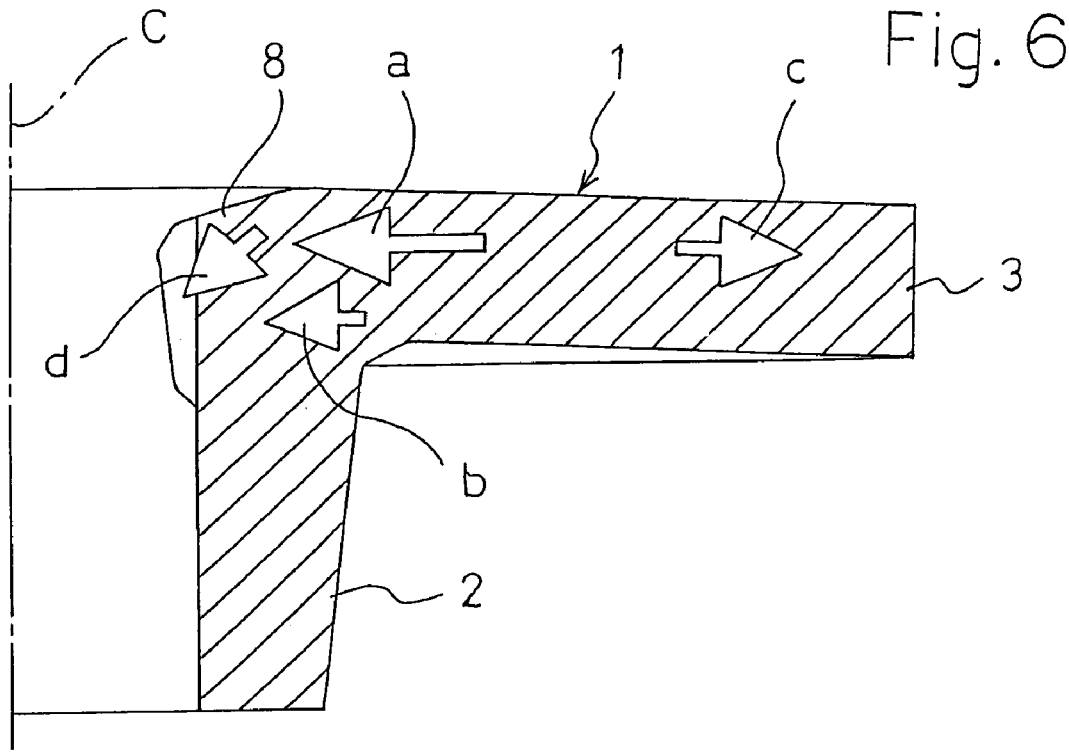
FIG. 6 is an enlarged half section view partially showing flows of a metal structure which are caused in a process of deforming the annular excess portion into a flat shape.
Figure 7:
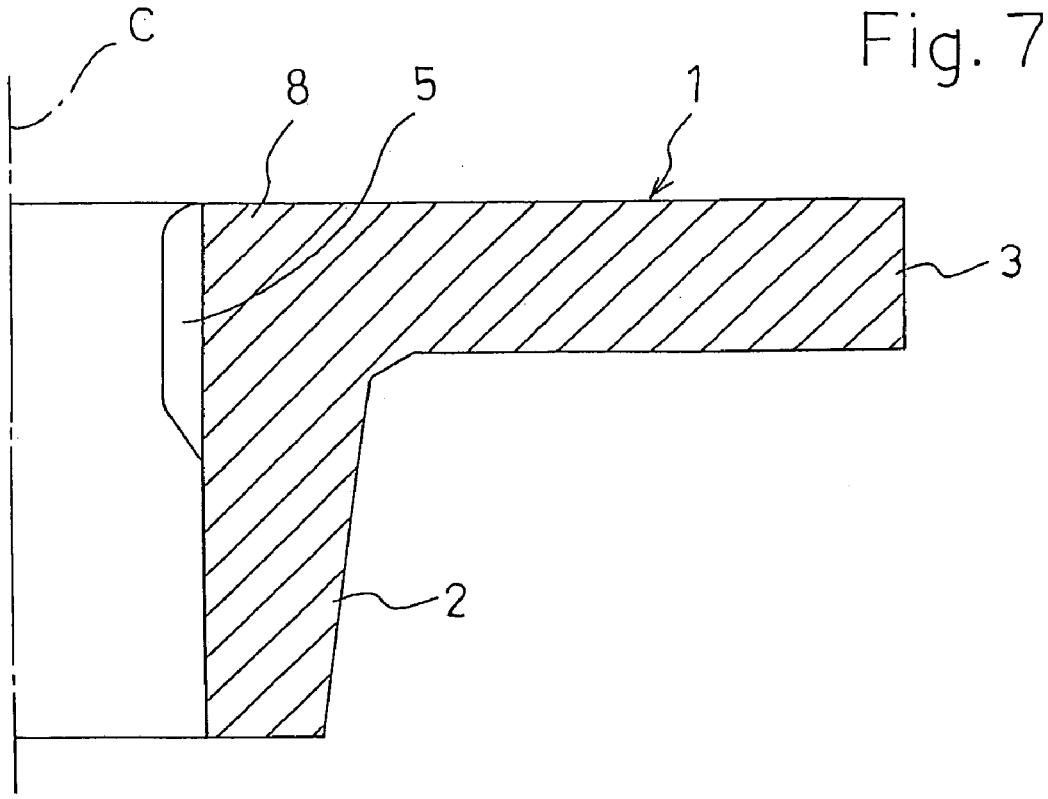
FIG. 7 is an enlarged half section view showing a state where a boss spline is formed.
Figure 8:
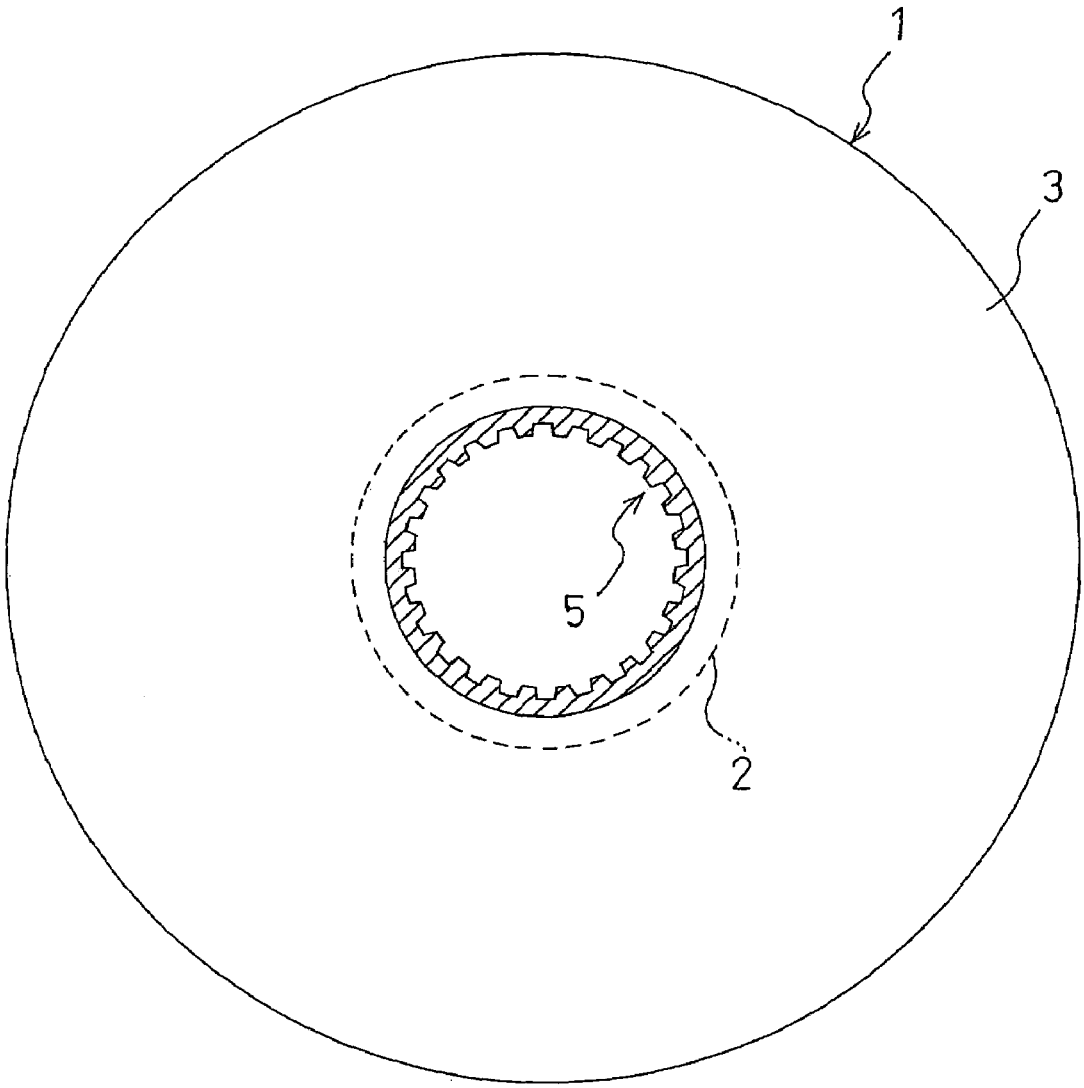
FIG. 8 is an overall plan view of FIG. 7.

When the pressing mold 12 in the butting state is further impelled toward the stationary mold 11, the annular excess portion 7 of the sheet metal-made rotary member 1 is pressed toward the holding face 9A by the pressing face 12A of the pressing mold 12, and then deformed into a flat shape as shown in FIG. 5 while the annular excess portion 7 is clamped between the pressing face 12A of the pressing mold 12 and the holding face 9A of the upper mold 9*a*1. It is considered that, during the process in which the annular excess portion 7 is deformed into a flat shape, flows indicated by the arrows a, b, c in FIG. 6 are produced in the metal structure of the annular excess portion 7. Namely, the large flows of the metal structure which are indicated by the arrows a, b, and which counter-radially gather toward the axis C, and the small flow of the metal structure which is indicated by the arrow c, and which radially separates from the axis C are produced. Because of the large flows (the arrows a, b) of the metal structure which counter-radially gather, the metal structure of the root portion 8 of the boss 2 is caused to flow as indicated by the arrow d, and plastically deformed while being squeezed into the spline forming grooves 10C, 10C, . . . of the spline forming male mold 10. As shown in FIG. 5, FIG. 7, and FIG. 8, finally, the boss spline 5 which protrudes toward the axis C1 more than the inner peripheral face of the boss 2 is formed in a moment.

In this case, the lower end of the boss 2 butts against the upper end of the small-diameter restricting portion 16A of the restricting member 16, and hence the downward elongation of the lower end of the boss 2 is restricted. Namely, it is possible to restrict the elongation of the tip end of the boss 2 in the direction of the axis C of the boss 2. Therefore, the boss spline 5 can be accurately formed, and the length in the direction of the axis C of the boss 2 can be uniformly set, so that dispersions can be suppressed.

The sheet metal-made rotary member 1 in which the boss spline 5 is formed can be easily recovered by retracting the pressing mold 12 to be separated from the stationary mold 11, and then removing the member from the stationary mold 11 by the function of, for example, a knock pin which is not shown.

When the boss spline 5 which protrudes toward the axis C1 more than the inner peripheral face of the boss 2 is formed by the method described above, the thickness of the sheet metal blank can be made equal to the effective thickness of the boss 2 so as to ensure the necessary strength of the boss 2. Therefore, the thickness of the sheet metal blank can be prevented from being thickened more than necessary, and increase in weight can be suppressed. As a result, reduction of the weight of the sheet metal-made rotary member 1 can be achieved, and the cost can be reduced. Moreover, the boss spline 5 is formed by squeezing the root portion 8 of the boss 2 into the spline forming grooves 10C, 10C, . . . of the spline forming male mold 10 to be plastically deformed in a moment. Therefore, the production efficiency can be remarkably improved, and significant cost reduction can be expected because of this also. Furthermore, cutting chips are not produced in the formation of the boss spline 5, and hence no adverse influence is exerted on the working environment.

In the embodiment, the case where the press molding apparatus 13 in which the pressing mold 12 functions as a movable mold to approach and separate from the stationary mold 11 configured by the combination of the rotary member holding mold 9 and the spline forming male mold 10 is used has been described. Alternatively, the press molding apparatus 13 in which the pressing mold 12 is fixed, and the stationary mold 11 functions as a movable mold to approach and separate from the pressing mold 12 may be used.

Figure 9:
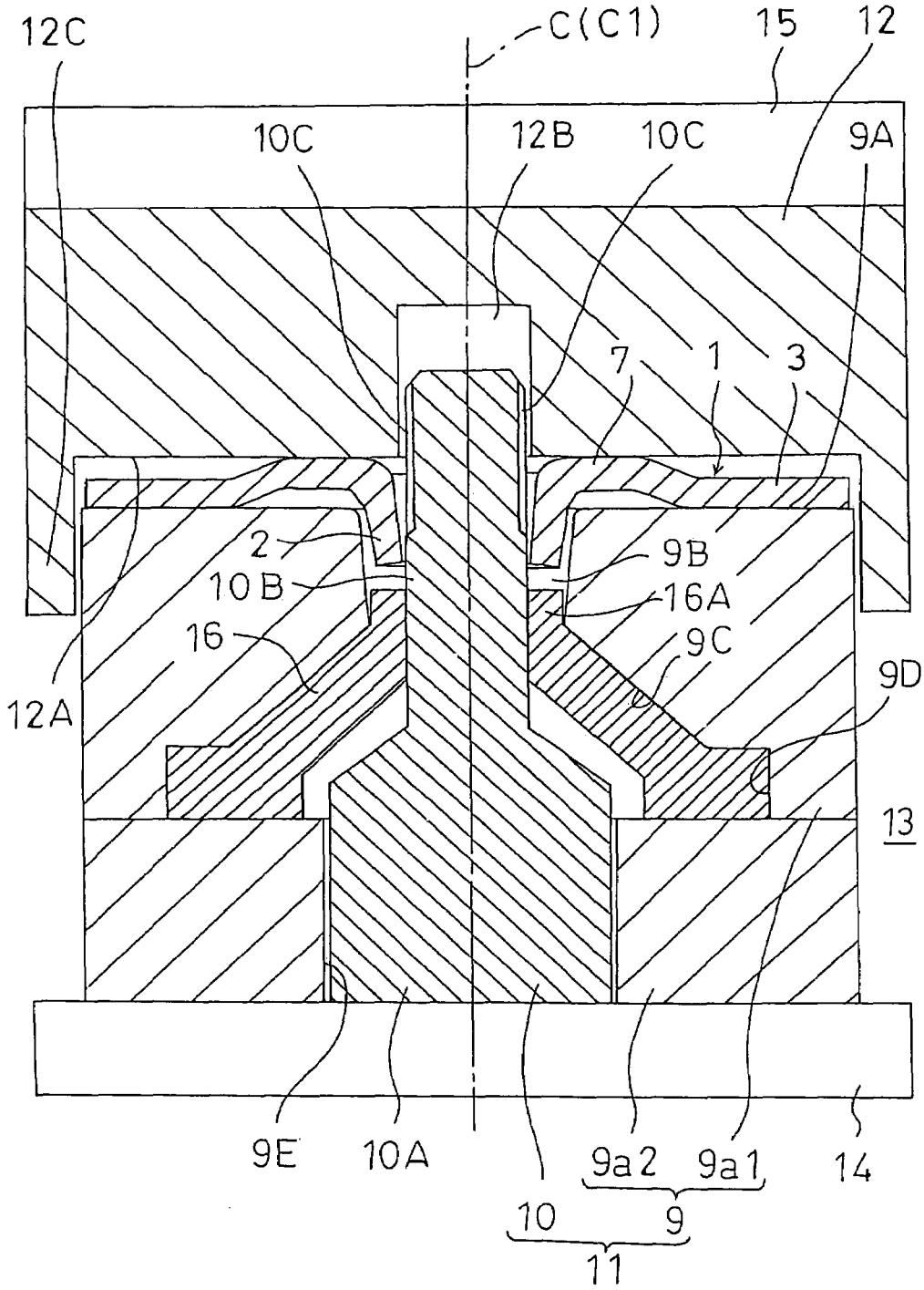
FIG. 9 is a longitudinal section view showing a modification of the pressing mold.

Alternatively, the press molding apparatus 13 in which, as shown in FIG. 9, a tubular portion 12C is formed integrally on an outer peripheral portion of the pressing mold 12 to form the pressing mold 12 into a cap-like shape, and, when the mold approaches the stationary mold 11, the tubular portion 12C is fitted onto the outer periphery of the rotary member holding mold 9 may be used.

Figure 10:
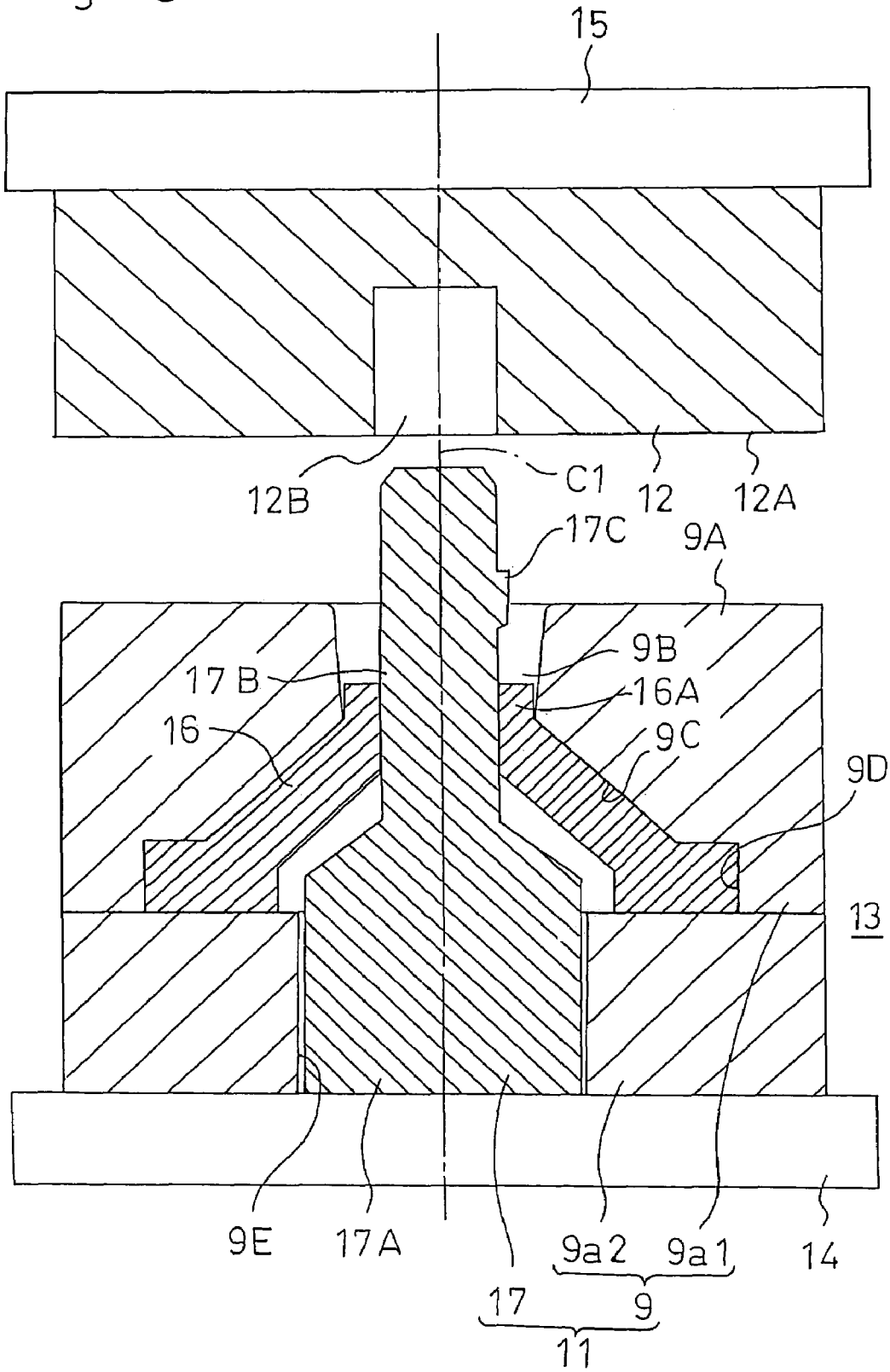
FIG. 10 is a longitudinal section view showing an example of a press molding apparatus which is applied to an embodiment of the invention set forth in claim 7.

Next, an embodiment of the method of forming a keyway of a sheet metal-made rotary member having a boss according to the invention set forth in claim 7 will be described with reference to the drawings. The method of forming a keyway is different from the spline forming method which has been described with reference to FIGS. 2 to 8, in that, as shown in FIG. 10, the stationary mold 11 is configured by a combination of the rotary member holding mold 9 into which the restricting member 16 is incorporated, and a keyway forming male mold 17. The keyway forming male mold 17 has a large-diameter basal portion 17A, and a small-diameter shaft portion 17B. A keyway forming projection 17C which elongates in a radial direction and the axial direction are disposed in the outer periphery of a tip end portion of the small-diameter shaft portion 17B and its vicinity. The components identical with those of the method of forming a spline according to the invention set forth in claim 1 which has been described with reference to FIGS. 2 to 8 are denoted by the same reference numerals, and duplicated description of the structure is omitted.

Figure 11:
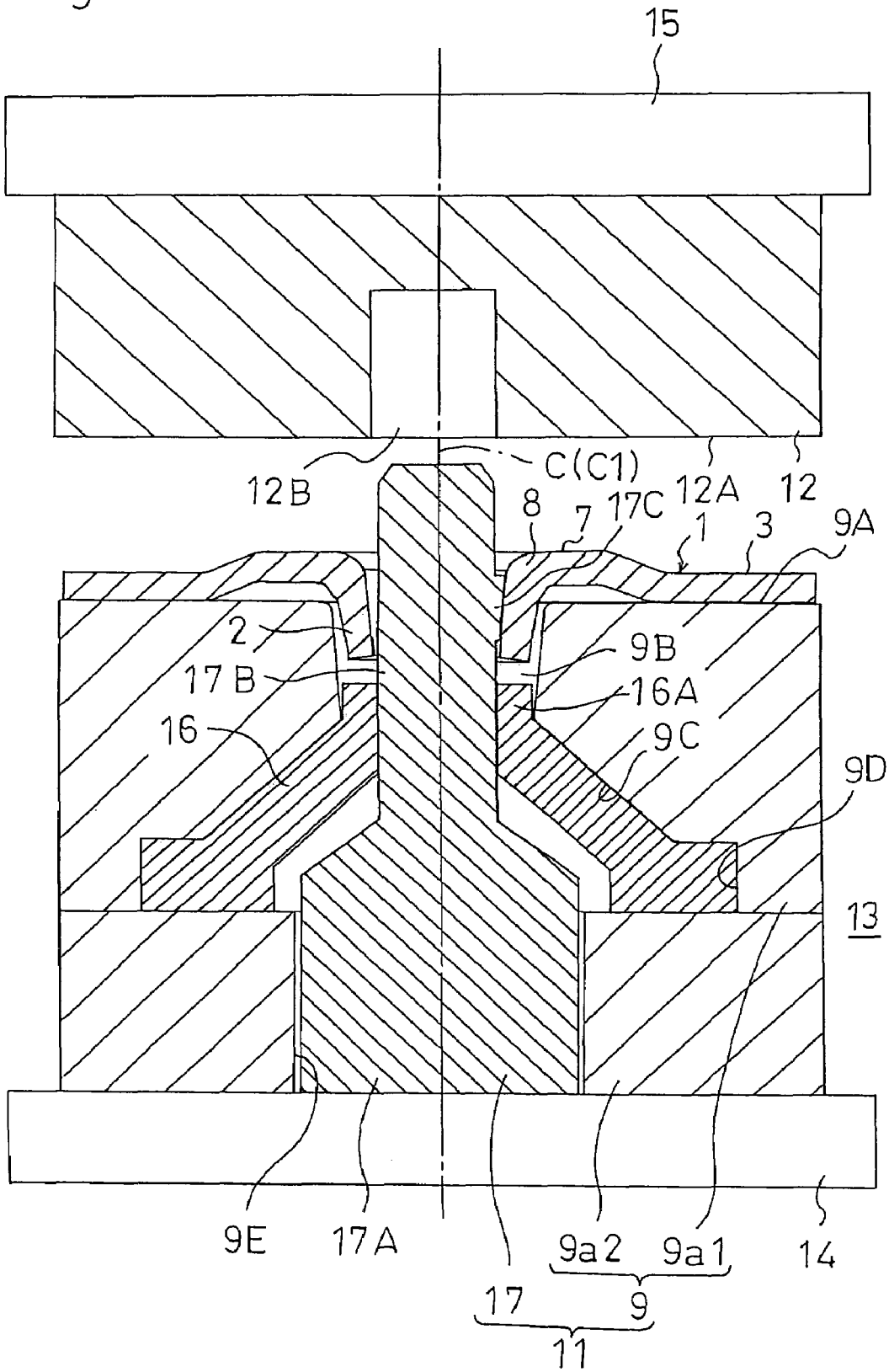
FIG. 11 is a longitudinal section view of a state where the sheet metal-made rotary member is set to a stationary mold.
Figure 12:
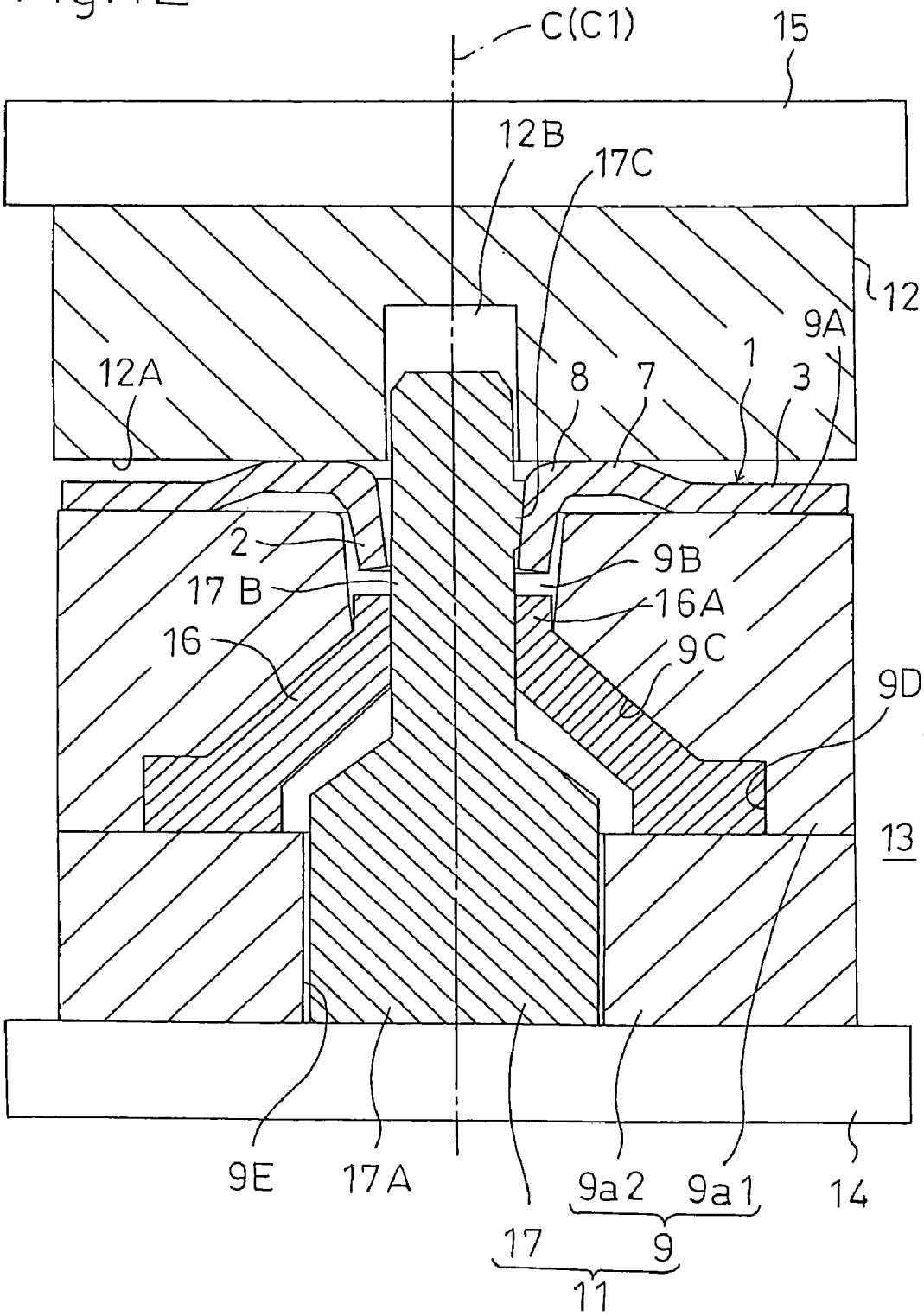
FIG. 12 is a longitudinal section view of a state where a pressing face of a pressing mold butts against an annular excess portion.

As shown in FIG. 11, the sheet metal-made rotary member 1 is set to the stationary mold 11, and the movable mold holding table 14 and the pressing mold 12 are impelled toward the stationary mold 11. First, the tip end side of the small-diameter shaft portion 17B of the keyway forming male mold 17 is fitted into the shaft fitting recess 12B. As shown in FIG. 12, then, the pressing face 12A of the upper mold 9*a*1 butts against the annular excess portion 7 of the sheet metal-made rotary member 1.

Figure 13:
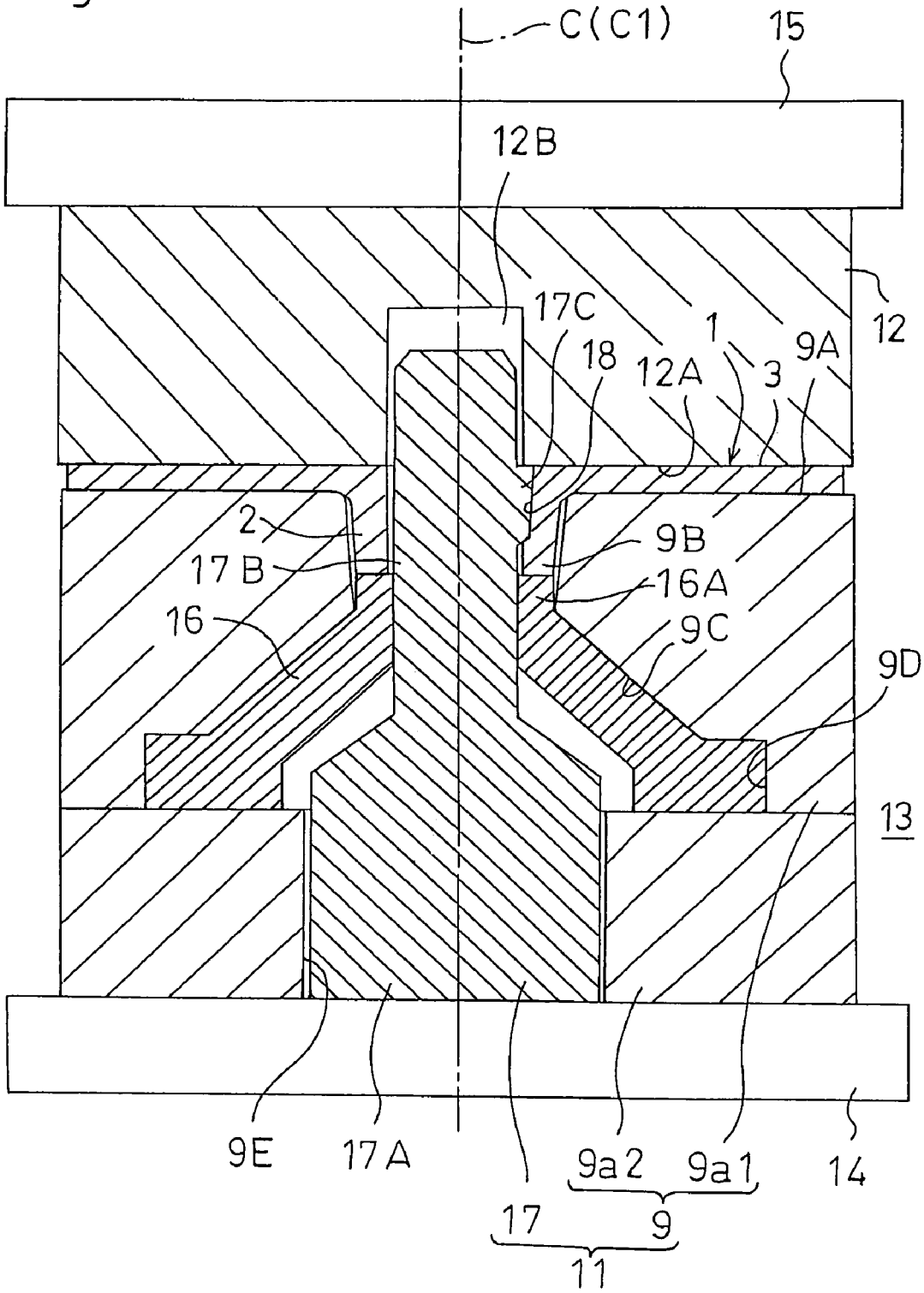
FIG. 13 is a longitudinal section view of a state where the annular excess portion is deformed into a flat shape.
Figure 14:
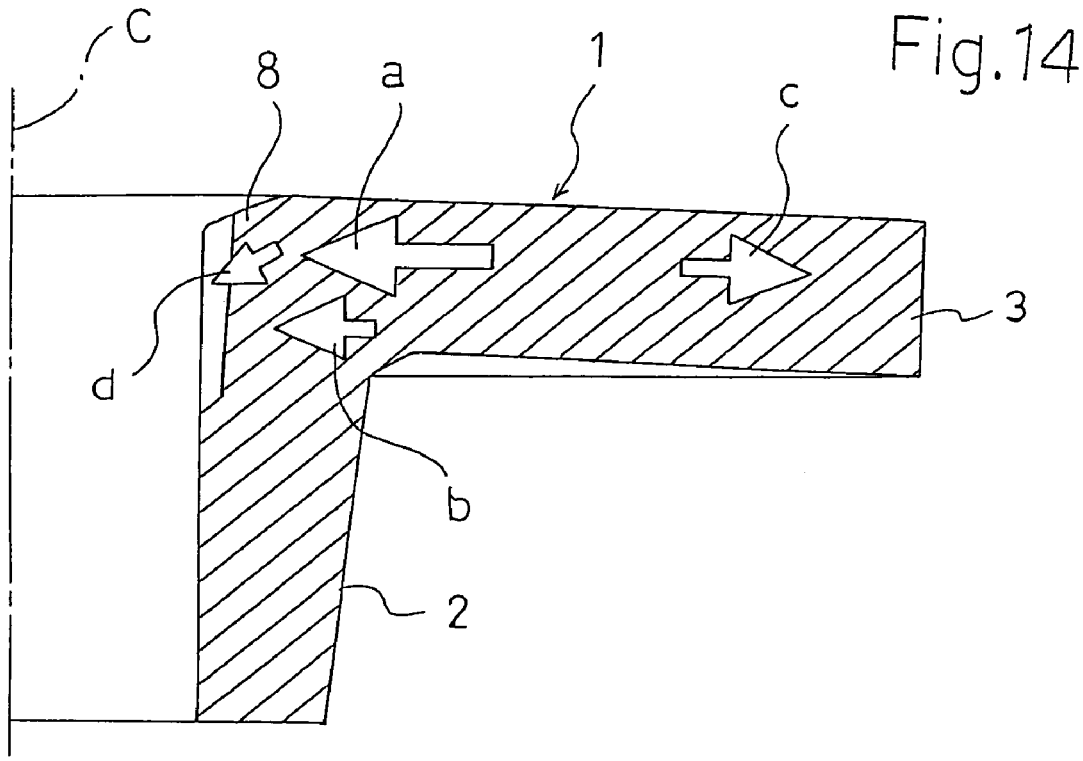
FIG. 14 is an enlarged half section view partially showing flows of a metal structure which are caused in a process of deforming the annular excess portion into a flat shape.
Figure 15:
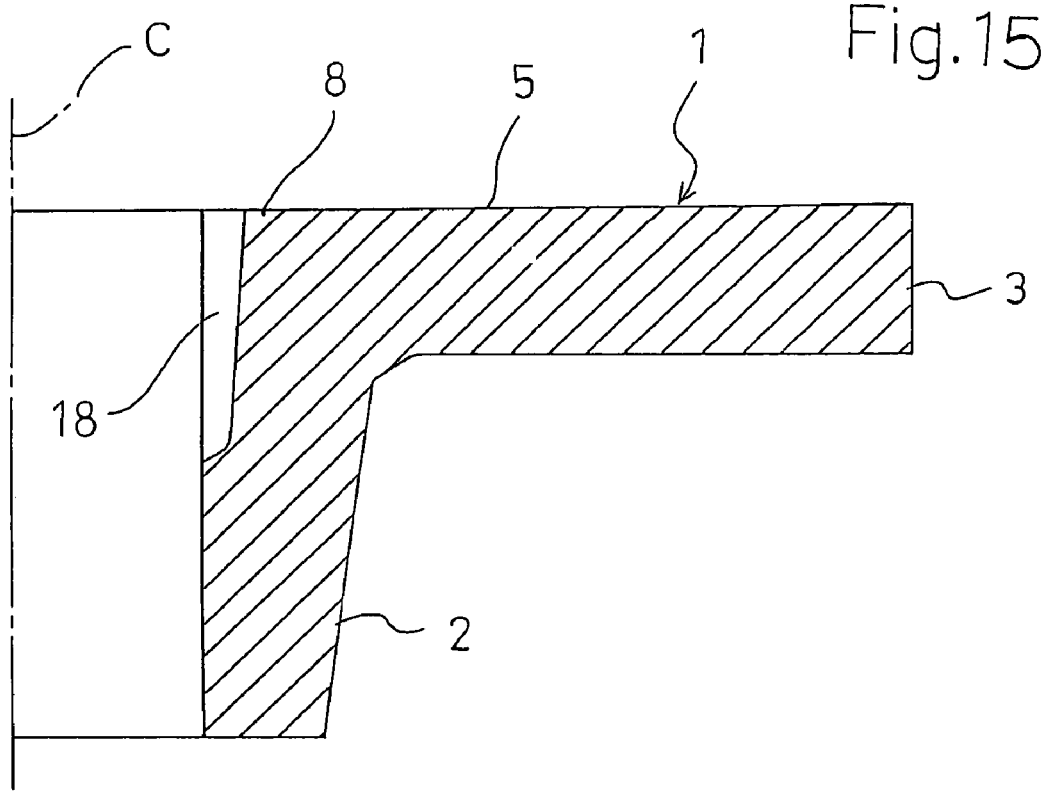
FIG. 15 is an enlarged half section view showing a state where a boss keyway is formed.
Figure 16:
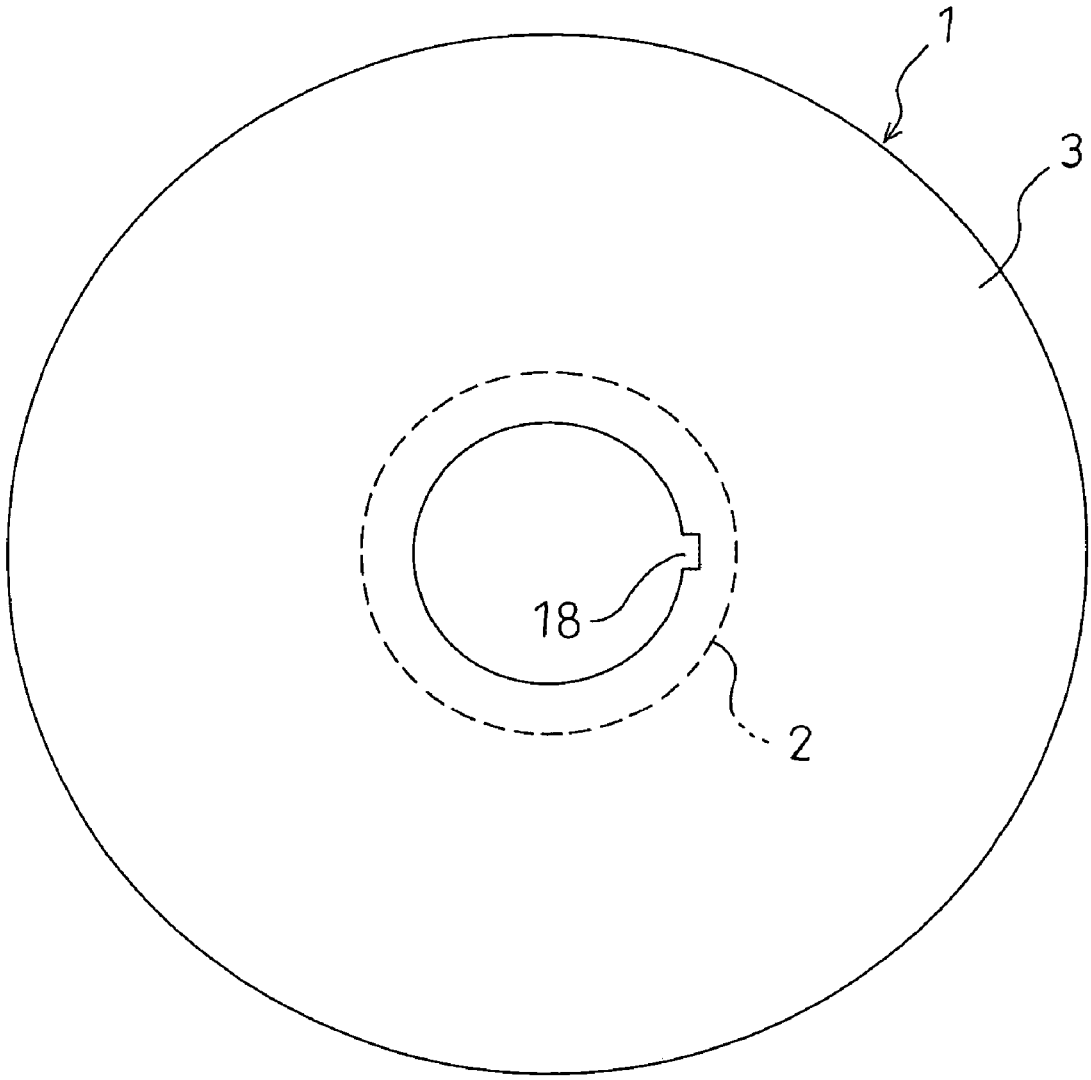
FIG. 16 is an overall plan view of FIG. 15.

When the pressing mold 12 in the butting state is further impelled toward the stationary mold 11, the annular excess portion 7 of the sheet metal-made rotary member 1 is pressed toward the holding face 9A by the pressing face 12A of the pressing mold 12, and then deformed into a flat shape as shown in FIG. 13 while the annular excess portion 7 is clamped between the pressing face 12A of the pressing mold 12 and the holding face 9A of the upper mold 9*a*1. During the process in which the annular excess portion 7 is deformed into a flat shape, flows indicated by the arrows a, b, c in FIG. 14 are produced in the metal structure of the annular excess portion 7, and the metal structure of a part in the circumferential direction of the root portion 8 of the boss 2 flows as indicated by the arrow d to be plastically deformed while being squeezed against the keyway forming projection 17C of the keyway forming male mold 17. As shown in FIG. 13, FIG. 15, and FIG. 16, finally, the boss keyway 18 which is recessed more than the inner peripheral face of the boss 2 toward the outer peripheral face is formed in a moment.

In this case, the lower end of the boss 2 butts against the upper end of the small-diameter restricting portion 16A of the restricting member 16, and hence the downward elongation of the lower end of the boss 2 is restricted. Namely, it is possible to restrict the elongation of the tip end of the boss 2 in the direction of the axis C of the boss 2. Therefore, the boss keyway 18 can be accurately formed, and the length in the direction of the axis C of the boss 2 can be uniformly set, so that dispersions can be suppressed.

The sheet metal-made rotary member 1 in which the boss keyway 18 is formed can be easily recovered by retracting the pressing mold 12 to be separated from the stationary mold 11, and then removing the member from the stationary mold 11 by the function of, for example, a knock pin which is not shown.

When the boss keyway 18 is formed in the boss 2 by the method described above, the thickness of the sheet metal blank can be made equal to the effective thickness of the boss 2 so as to ensure the necessary strength of the boss 2. Therefore, the thickness of the sheet metal blank can be prevented from being thickened more than necessary, and increase in weight can be suppressed. As a result, reduction of the weight of the sheet metal-made rotary member 1 can be achieved, and the cost can be reduced. Moreover, the boss keyway 18 is formed by squeezing a part in the circumferential direction of the root portion 8 of the boss 2 against the keyway forming projection 17C to be plastically deformed in a moment. Therefore, the production efficiency can be remarkably improved, and significant cost reduction can be expected because of this also. Furthermore, cutting chips are not produced in the formation of the boss keyway 18, and hence no adverse influence is exerted on the working environment.

In the same manner as the invention set forth in claim 1, the press molding apparatus 13 in which the pressing mold 12 is fixed, and the stationary mold 11 functions as a movable mold to approach and separate from the pressing mold 12 may be used.

Alternatively, the press molding apparatus 13 in which, as shown in FIG. 9, the tubular portion 12C is formed integrally on the outer peripheral portion of the pressing mold 12 so as to form the pressing mold 12 into a cap-like shape, and, when the mold approaches the stationary mold 11, the tubular portion 12C is fitted onto the outer periphery of the rotary member holding mold 9 may be used.

As described above, the invention provides a technique in which an annular excess portion that is disposed between a boss of a sheet metal-made rotary member and a peripheral portion so as to protrude in one axial direction is pressed against a holding face of a rotary member holding mold by a pressing face of a pressing mold, and, while the annular excess portion is clamped between the faces to be deformed into a flat shape, a part of the metal structure of a root portion of the boss is squeezed into spline forming grooves of a spline forming male mold to be plastically deformed. As a result, weight reduction can be achieved without causing the thickness of a sheet metal blank to be increased more than necessary, and cost reduction can be realized by remarkable improvement of the production efficiency.

The invention claimed is:

1. A method of forming a spline in a boss of a sheet metal-made rotary member which comprises the boss and a peripheral portion in an outer periphery of the boss, and in which an annular excess portion that protrudes in one axial direction of the boss is disposed between the boss and the peripheral portion, and a root portion of the boss and the peripheral portion are displaced in the axial direction of the boss, the method comprising the steps of:

passing a spline forming a male mold through the boss of the sheet metal-made rotary member, the boss being fitted into a boss fitting hole of a rotary member holding mold to hold the sheet metal-made rotary member holding mold to hold the sheet metal-made rotary member to the rotary member holding mold in a state where the annular excess portion separates from a holding face; and impelling a pressing mold toward the rotary member holding mold to press the annular excess portion against the holding face of the rotary member holding mold, and the root portion of the boss is squeezed against the spline forming male mold to be plastically deformed, while the annular excess portion is clamped between a pressing face of the pressing mold and the holding face of the rotary member holding mold to be deformed into a flat shape, whereby a boss spline is formed in the root portion of the boss.

2. The method of forming a spline of a sheet metal-made rotary member having a boss according to claim 1, further comprising the step of:

causing a tip end of the boss to butt against an end face of a truncated conical restricting member which is incorporated into the rotary member holding mold, when the boss spline is formed by squeezing the root portion of the boss against the spline forming male mold to be plastically deformed, while the annular excess portion is clamped between the pressing face of the pressing mold and the holding face of the rotary member holding mold to be deformed into a flat shape, thereby restricting elongation of the tip end of the boss in the axial direction of the boss.

3. The method of forming a spline of a sheet metal-made rotary member having a boss according to claim 1, further comprising the step of:

splitting the split mold into two mold parts in the axial direction, a flat holding face which is perpendicular to the axis, and which is opposed to the pressing face of the pressing mold, and the boss fitting hole which elongates from the holding face in the axial direction, and which is centered at the axis are disposed in one of the split mold parts, and a spline forming male mold holding hole which fittingly holds a large-diameter basal portion of the spline forming male mold is disposed in another one of the split mold part, wherein the split mold is used as the rotary member holding mold.

4. The method of forming a spline of a sheet metal-made rotary member having a boss according to claim 2, further comprising the step of:

splitting the split mold into two mold parts in the axial direction, a flat holding face which is perpendicular to the axis, and which is opposed to the pressing face of the pressing mold, the boss fitting hole which elongates from the holding face in the axial direction, and which is centered at the axis, and a restricting member holding hole which fittingly holds the truncated conical restricting member are disposed in one of the split mold parts, and a spline forming male mold holding hole which fittingly holds a large-diameter basal portion of the spline forming male mold is disposed in another one of the split mold parts, wherein the split mold is used as the rotary member holding mold.

5. The method of forming a spline of a sheet metal-made rotary member according to claim 1, wherein:

a press molding apparatus is used, a mold configured by a combination of the rotary member holding mold and the spline forming male mold, and the pressing mold having the same axis, and the press molding apparatus causes the molds to approach and separate from each other to allow one of the molds to function as a stationary mold, and another one of the molds to function as a movable mold.

6. The method of forming a spline of a sheet metal-made rotary member according to claim 1, wherein:

a mold which has a tubular potion that, when said mold approaches said rotary member holding mold, is fitted onto an outer periphery of said rotary member holding mold, and which is formed into a cap-like shape is used as the pressing mold.

7. The method of forming a keyway in a boss of a sheet metal-made rotary member which comprises the boss and a peripheral portion in an outer periphery of the boss, and in which an annular excess portion that protrudes in one axial direction of the boss is disposed between said boss and the peripheral portion, and a root portion of said boss and the peripheral portion are displaced in the axial direction of the boss, the method comprising the steps of:

passing a keyway forming a male mold through the boss of the sheet metal-made rotary member, the boss being fitted into a boss fitting hole of a rotary member holding mold to hold the sheet metal-made rotary member to the rotary member holding mold in a state where the annular excess portion separates from a holding face; and impelling a pressing mold toward the rotary member holding mold to press the annular excess portion against the holding face of the rotary member holding mold, and the root portion of the boss is squeezed against said keyway forming male mold to be plastically deformed, while the annular excess portion is clamped between a pressing face of the pressing mold and the holding face of the rotary member holding mold to be deformed into a flat shape, whereby a boss keyway is formed in said root portion of the boss.

8. The method of forming a keyway of a sheet metal-made rotary member having a boss according to claim 7, further comprising the step of:

causing a tip end of the boss to butt against an end face of a truncated conical restricting member which is incorporated into the rotary member holding mold, when the boss keyway is formed by squeezing the root portion of the boss against the keyway forming male mold to be plastically deformed, while the annular excess portion is clamped between the pressing face of the pressing mold and the holding face of the rotary member holding mold to be deformed into a flat shape, thereby restricting elongation of the tip end of the boss in the axial direction of the boss.

9. The method of forming a keyway of a sheet metal-made rotary member having a boss according to claim 7, further comprising the step of:

splitting the split mold into two mold parts in the axial direction, a flat holding face which is perpendicular to the axis, and which is opposed to the pressing face of the pressing mold, and the boss fitting hole which elongates from the holding face in the axial direction, and which is centered at the axis are disposed in one of the split mold parts, and a keyway forming male mold holding hole which fittingly holds a large-diameter basal portion of the keyway forming male mold is disposed in another one of the split mold parts wherein a split mold is used as the rotary member holding mold.

10. The method of forming a keyway of a sheet metal-made rotary member having a boss according to claim 8, further comprising the step of:

splitting the split mold into two mold parts in the axial direction, a flat holding face which is perpendicular to the axis, and which is opposed to the pressing face of the pressing mold, the boss fitting hole which elongates from the holding face in the axial direction, and which is centered at the axis, and a restricting member holding hole which fittingly holds the truncated conical restricting member are disposed in one of the split mold parts, and a keyway forming male mold holding hole which fittingly holds a large-diameter basal portion of the keyway forming male mold is disposed in another one of the split mold parts wherein a split mold is used as the rotary member holding mold.

11. The method of forming a keyway of a sheet metal-made rotary member according to claim 7, wherein:

a press molding apparatus is used, a mold configured by a combination of the rotary member holding mold and the keyway forming male mold, and the pressing mold have a same axis, and the press molding apparatus causes the molds to approach and separate from each other to allow one of the molds to function as a stationary mold, and another one of the molds to function as a movable mold.

12. The method of forming a keyway of a sheet metal-made rotary member according to claim 7, wherein:

a mold which has a tubular potion that, when the mold approaches the rotary member holding mold, is fitted onto an outer periphery of the rotary member holding mold, and which is formed into a cap-like shape is used as the pressing mold.

* * * * *